United States Patent [19]

Klingen

[11] Patent Number: 5,046,450

[45] Date of Patent: Sep. 10, 1991

[54] APPARATUS FOR INTERIOR COATING OF CAVITIES

[75] Inventor: Willi Klingen, Markdorf, Fed. Rep. of Germany

[73] Assignee: J. Wagner GmbH, Fed. Rep. of Germany

[21] Appl. No.: 538,897

[22] Filed: Jun. 15, 1990

[30] Foreign Application Priority Data

Jun. 19, 1989 [DE] Fed. Rep. of Germany ..... 3919959

[51] Int. Cl.[5] ..... B05C 7/02

[52] U.S. Cl. ..... 118/668; 114/224; 118/317; 222/326

[58] Field of Search ..... 118/668, 669, 679, 306, 118/317; 141/194, 346, 347, 350; 114/224; 222/326

[56] References Cited

U.S. PATENT DOCUMENTS 2,337,709 12/1943 Casher et al. ..... 118/317
2,604,872 7/1952 Brown ..... 118/317
2,814,083 11/1957 Beyer ..... 118/306
4,546,724 10/1985 Kiru et al. ..... 118/669

*Primary Examiner*—Willard E. Hoag
*Attorney, Agent, or Firm*—Hill, Van Santen, Steadman & Simpson

[57] ABSTRACT

An apparatus for the interior coating of cavities, particularly of an automobile body, comprising a spray gun having a nozzle probe plug-in coupling and spray shot trigger means and comprising nozzle probes connected to the spray gun, each thereof being allocated to a defined cavity and being composed of a nozzle tube having a plug-in end, nozzle end and positioning detent is created wherein a spray shot is only output or, respectively, can only be output when a full seating of the positioning detent against the outside wall of the cavity has been achieved. This is achieved in the positioning detent is provided with at least one contact sensor that is in an interactive connection with the spray shot trigger means of the spray gun.

10 Claims, 4 Drawing Sheets

APPARATUS FOR INTERIOR COATING OF CAVITIES

BACKGROUND OF THE INVENTION

The invention is directed to an apparatus for the interior coating of cavities, particularly of an automobile body, comprising a spray gun having a spray nozzle plug-in coupling and a spray shot trigger means and comprising nozzle probes pluggable to the spray gun, each nozzle probe being composed of a nozzle tube having a plug-in end, nozzle end and positioning detent.

Such an apparatus is disclosed by EP 140 017. In the disclosed apparatus, spray probes are detachably secured to a spray gun. The spray probes are stored in a holder part having a plurality of receptacles and are taken as needed by the worker and secured on the spray gun. Every receptacle in the spray probe holder has a holder as well as a display lamp allocated to it, this lamp being respectively lit when the corresponding spray probe has been removed from the holder. In addition, a symbol display panel having small lamps likewise allocated thereto is present, this being connected with lines to the spray probe holder and to a control means and the respective spraying position of the corresponding spray probe being displayed thereon, whereby the small lamps are respectively lit as the corresponding lamp at the spray probe holder lights up given removal of the spray probe. On the basis of the worker's attention, it is thus assured with the system that the correct spray probe is introduced into the correct cavity. Measures for assuring that the spray probe is correctly introduced into the cavity with respect to direction and depth (exact seating of the positioning detent against the wall of the cavity surrounding the introduction opening), however, are not provided in the known apparatus. The same is also true of the procedure of correctly fastening the spray probe to the spray gun.

SUMMARY OF THE INVENTION

It is therefore an object of the present invention to assure that, regardless of the worker's attention, a spray shot is always triggered or, respectively, can be triggered only when the spray probe, secured correctly and liquid-tight to the spray gun, has been correctly introduced, with respect to introduction depth and introduction direction into the cavity to be coated. This object is achieved by providing the positioning detent with at least one contact sensor that has an interactive connection with the spray shot trigger means of the spray gun.

A plurality of contact sensors may be provided at spaced locations on the positioning detent. The contact sensors can be either mechanical or electrical with the ultimate connection to the spray shot trigger being electrical. For example, a bell crank type lever may be pivotally attached to the positioning detent such that one free end of the lever will be selectively engageable with the wall of the cavity to be coated. When that end of the lever engages the wall, the second end of the lever is caused to move due to a pivoted connection of the lever to the positioning detent. A mechanical connection means such as a Bowden cable can connect the second end of the lever to a movable sleeve carried on the nozzle tube which is caused to move toward an electrical proximity switch upon engagement of the first end of the lever with the cavity wall.

Alternatively, proximity switches can be mounted directly to the positioning detent to electrically sense the appropriate coupling of the spray gun to the cavity wall. Further still, a spring biased pin may be positioned on the positioning detent movable upon engagement with the cavity wall toward a proximity switch also carried on the positioning detent.

In the case of more than one positioning sensor being utilized on the positioning detent, all of the switches should be interconnected by AND circuitry to the spray shot trigger means so that it is required that all of the sensors be properly seated against the cavity wall in order for the spray shot to be triggered.

BRIEF DESCRIPTION OF THE DRAWINGS

The invention shall be set forth in greater detail below with reference to the drawings.

DESCRIPTION OF THE PREFERRED EMBODIMENTS

Figure 1:
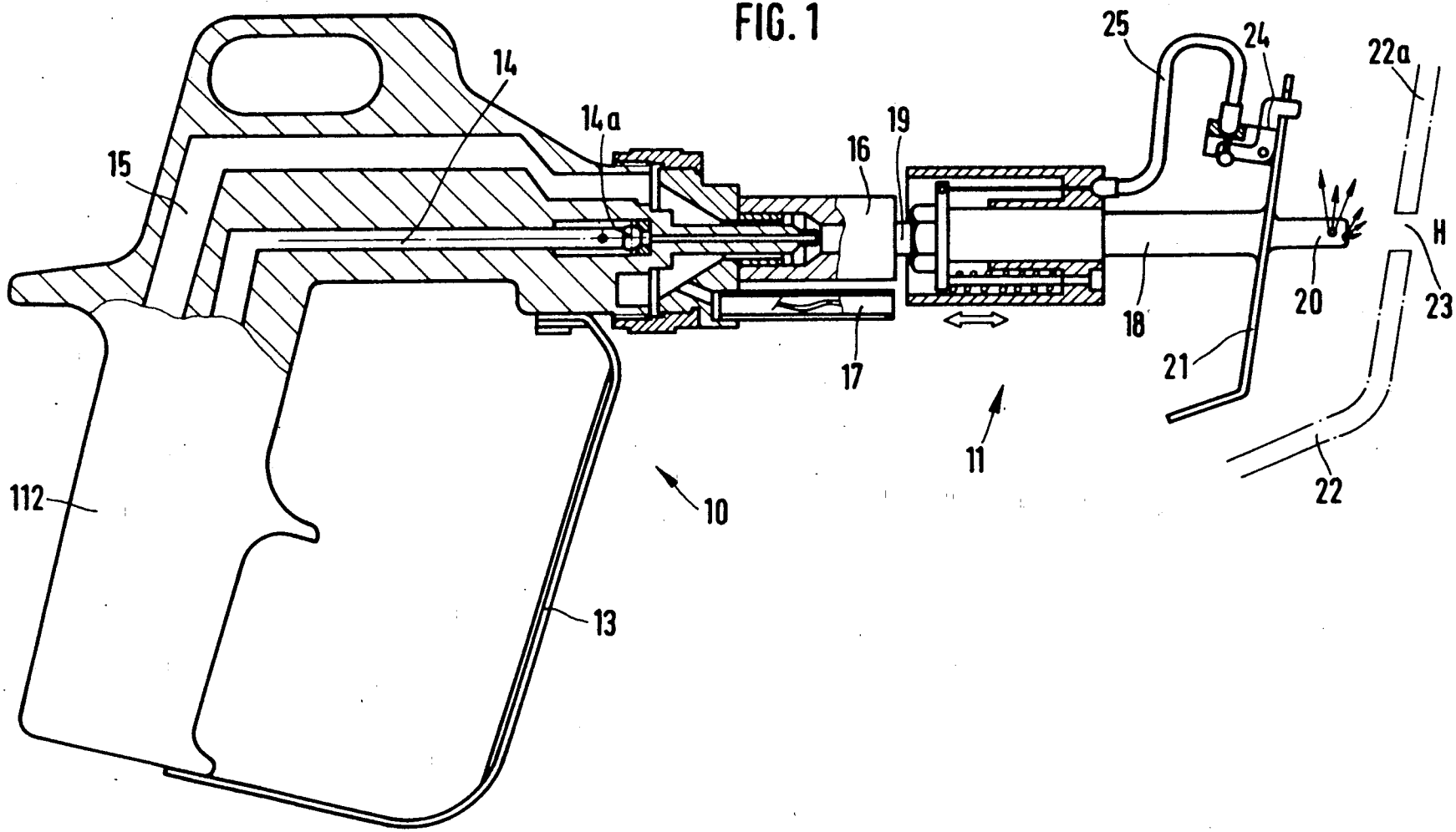
FIG. 1 is a partial side sectional view of a first embodiment of the invention.
Figure 2:
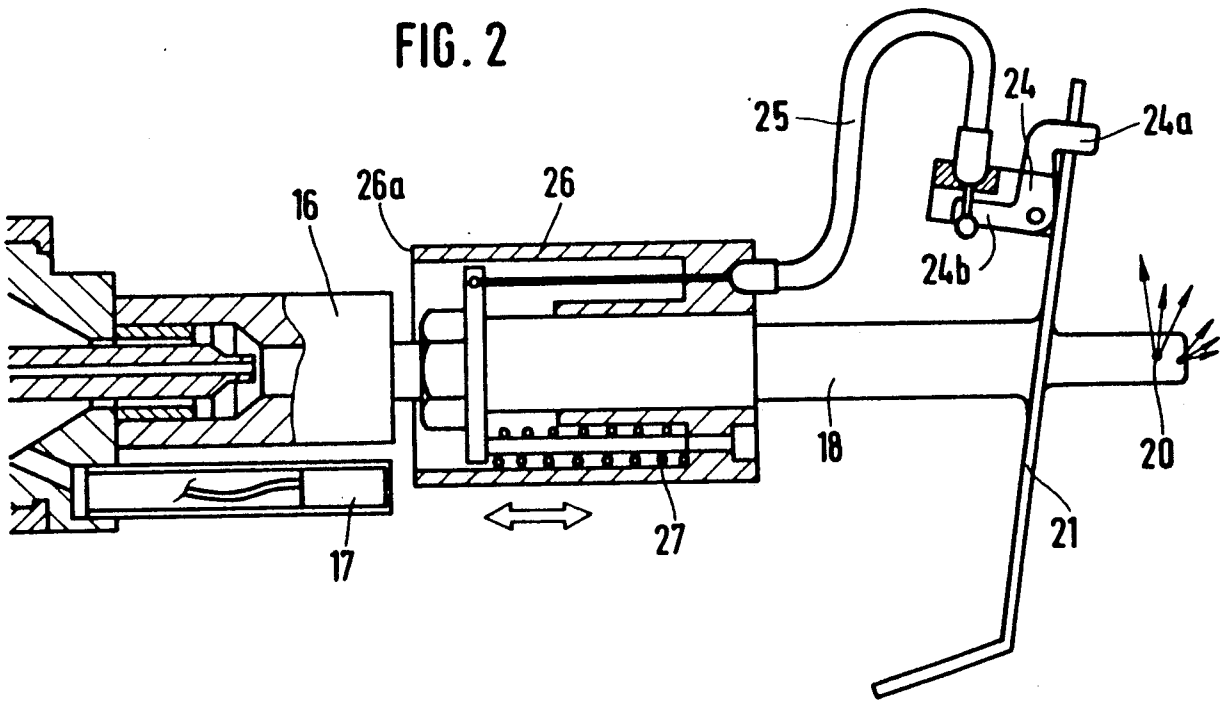
FIG. 2 is a side sectional view of the spray probe portion of the apparatus of FIG. 1 shown in an enlarged scale.

In the exemplary embodiment of FIGS. 1 and 2, 10 references a spray gun and 11 references a spray probe detachably secured thereto. The spray gun 10 has a handle 112, a guard bow 13, a liquid channel 14 with valve **14*a* and a compressed air channel 15. At its front end, the spray gun 10 is provided with a liquid-tight, mechanical plug-in coupling 16 for the acceptance of the spray probe 11. A proximity switch 17 is situated immediately next to the plug-in coupling 16. The nozzle probe 11 comprises a nozzle tube 18 whose back end is fashioned as a plug insert 19 for introduction into the opening of the coupling 16 and whose front end is provided with nozzle apertures 20. A positioning detent 21 is secured to the nozzle tube 18 at a prescribed distance behind the nozzle apertures 20, the shape of this positioning detent 21 being matched to the wall 22 (shown with broken lines in the drawings) in the region around the introduction opening 23 for the nozzle tube 18 that limits the cavity H to be coated. A double-armed lever 24 is pivotably hinged to a selected location of the backside of the positioning detent 21, the one end of this double-armed lever 24, as a contact sensor, engaging through an opening in the positioning detent 21 and the other end thereof being connected to a Bowden cable 25. The other end of the Bowden cable 25 is in interactive communication with a sleeve 26 that coaxially surrounds the nozzle tube 18 and can be pushed back and forth to a limited extent in axial direction, whereby the sleeve 26 is loaded by a coil spring 27 in displacement direction toward the nozzle aperture end of the nozzle tube 18. The arrangement thus provides that, in the idle position shown in FIGS. 1 and 2, the spring 27 has displaced the sleeve 26 into its right-hand final position in which the contact sensor end 24*a* of the lever 24 projects slightly beyond the front side of the positioning detent 21 and in which the back face edge 26*a* of the sleeve 26 is spaced away from the proximity switch 17 of the spray gun 10**.

When the spray gun 10 having the nozzle probe 11 put in place thereon then approaches the cavity to be coated and the front end of the nozzle tube 18 is introduced into the cavity through the opening 23 of the wall 22, then the positioning detent 21 is ultimately placed against the outside surface 22*a* of the wall 22, wherewith the nozzle apertures 20 are then situated at the desired location in the cavity H and also assume the desired directional position. When the positioning detent 21 lies against the outside surface 22*a* under pressure, the contact sensor end 24*a* of the lever 24 is pressed in, i.e. the lever 24 is pivoted by a prescribed angle in counter-clockwise direction, with the consequence that the sleeve 26 is displaced toward the left against the force of the spring 27 via the Bowden cable 25, whereby the face edge 26*a* of the sleeve 26 damps the proximity switch 17 at the end of the displacement path. The proximity switch 17 thus outputs a switch signal that is utilized to release the triggering of the spray shot. This, for example, can ensue such that the valve 14*a* of the fluid line 14 is a solenoid valve that is directly or indirectly controlled by the proximity switch 17, which thus opens on the basis of the switch signal and releases the spray shot. After a preselected time, the valve is again closed by a standard timer circuit. In the case just set forth, thus, a triggering of the spray shot ensues automatically without the worker actuating the trigger. However, it is also possible to provide the spray gun with a trigger actuatable by the worker and with, for example, an electromagnetic trigger lock that only allows the trigger to be pulled when the proximity switch 17 has output its switch signal. Finally, one can also proceed such that it is in fact necessary to previously pull the trigger for opening the valve 14*a*, but the valve only opens when it is driven by the switch signal of the proximity switch 17.

Although only a single lever 24 having the contact sensor end 24*a* is shown in the illustrated exemplary embodiment of FIGS. 1 and 2, it is preferable to provide two levers 24 with a Bowden cable 25 leading to the sleeve 26, whereby the two contact sensor locations are situated as far as possible from one another, for example approximately diametrically relative to the nozzle tube 18. The reliability with respect to a complete seating of the positioning detent 21 against the surface 22*a* is thus increased and a more uniform transmission of force onto the sleeve 26 is guaranteed. Given surfaces 22*a* that are extremely complex in terms of shape, it can even be expedient to provide a three-point contact, i.e. to equip the positioning detent 21 with three levers 24 each having a respective Bowden cable 25.

Figure 3:
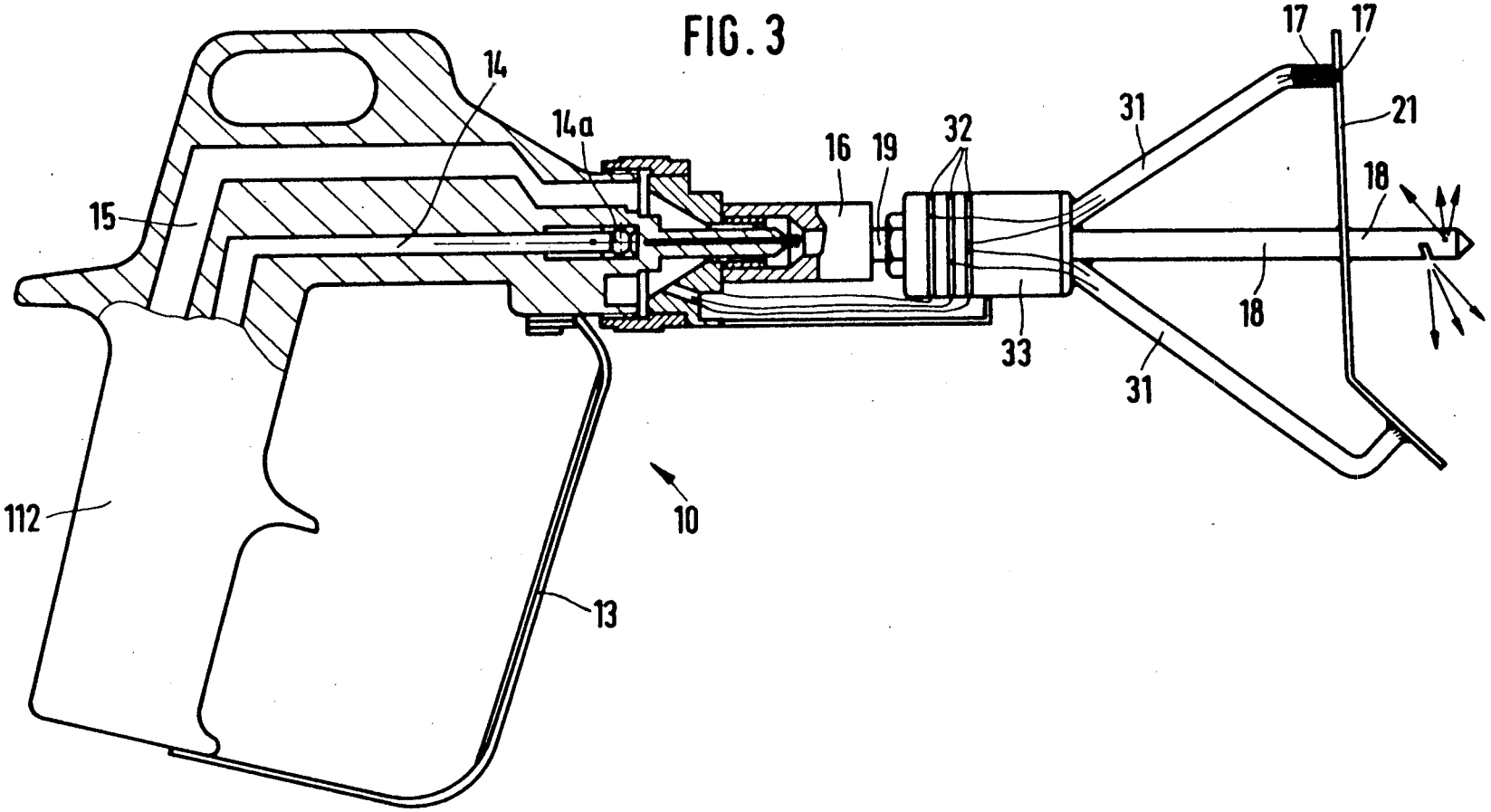
FIG. 3 is a partial side sectional view of a second embodiment of the invention.
Figure 4:
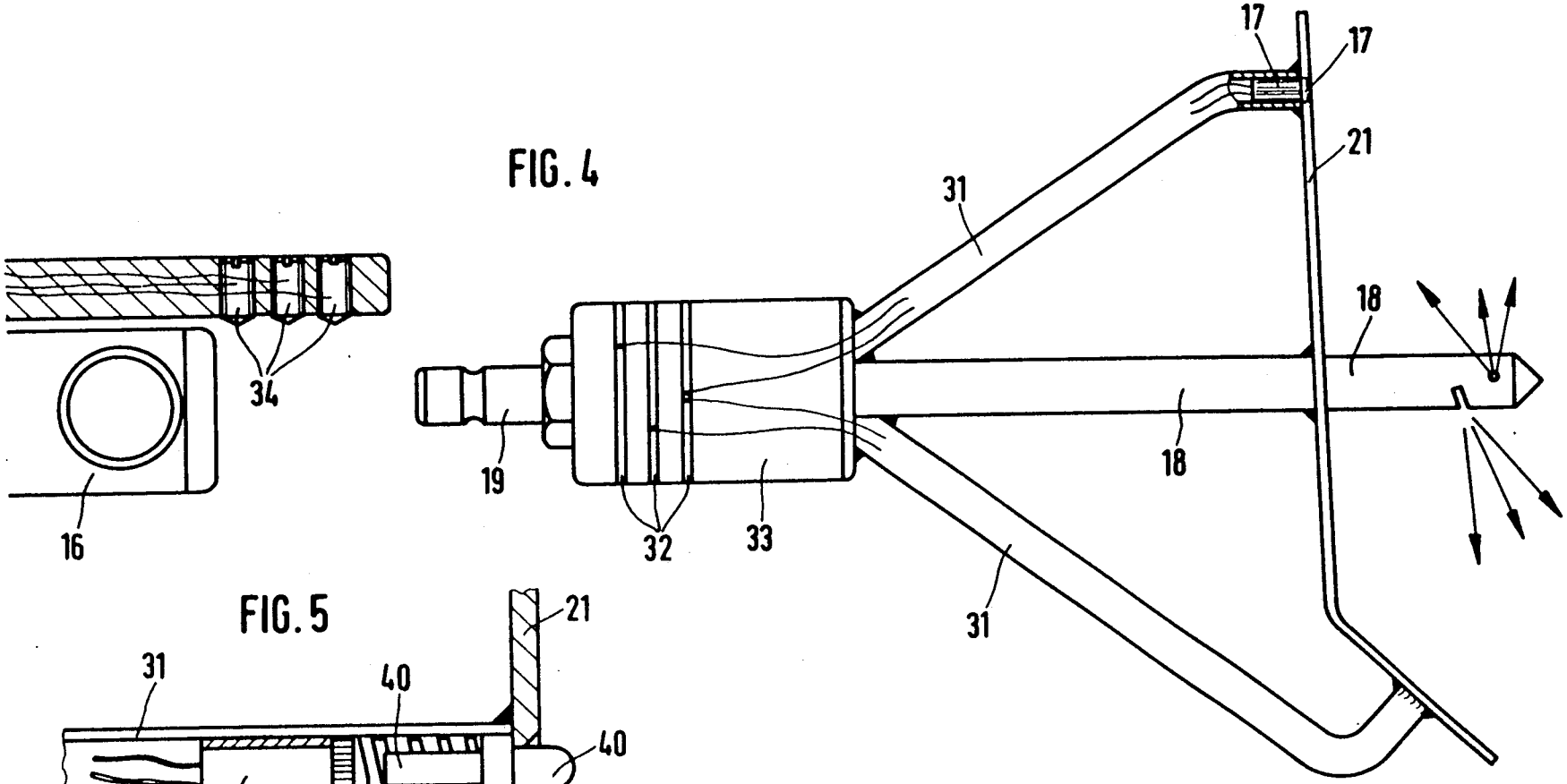
FIG. 4 is an exploded side elevational view of the spray probe and gun coupling portions of the apparatus of FIG. 3 shown in an enlarged scale.

A second embodiment of the invention is illustrated in FIGS. 3 and 4. Parts that are identical to those of the embodiment of FIG. 1 are thereby referenced with the same reference characters. By contrast to the first exemplary embodiment, the proximity switches 17 here directly represent the contact sensors. To this end, proximity switches 17 are accommodated at the open orifice end of stay-like tubes 31 that lead to the plug-in end of the nozzle tube 18 and simultaneously serve as receptacles for the proximity switches 17 and as stabilizers for the positioning detent 21. The proximity switches 17 penetrate clearances or openings in the positioning detent 21 such that their contact surface aligns with the front face of the positioning detent 21. The electrical lines of the proximity switches 17 are conducted in the stabilizer tubes 31 up into the region of the nozzle tube 18 and are in conductive connection there with contact rings 32 that are situated on the surface of a contact cylinder 31 that coaxially surrounds the nozzle tube 18. The contact rings 32 contact a finger-like contactor 34 situated next to the plug-in coupling 16 of the spray gun 10, so that there is a conductive connection between the proximity switches 17 and the spray gun 10 when a spray probe 11 is put in place on the spray gun 10. The functioning of this apparatus is substantially identical to that described relative to the first exemplary embodiment. When the front face of the positioning detent 21 lies against the outside surface of the cavity wall, then the proximity switches 17 send a switch signal to the spray gun that releases the triggering of the spray shot. What is thereby critical is that the two proximity switches 17 are interconnected in AND circuitry, i.e. that a switch signal is only forwarded when both proximity switches 17 simultaneously respond, similar to the employment of two proximity switches 17 in the first exemplary embodiment.

Figure 5:
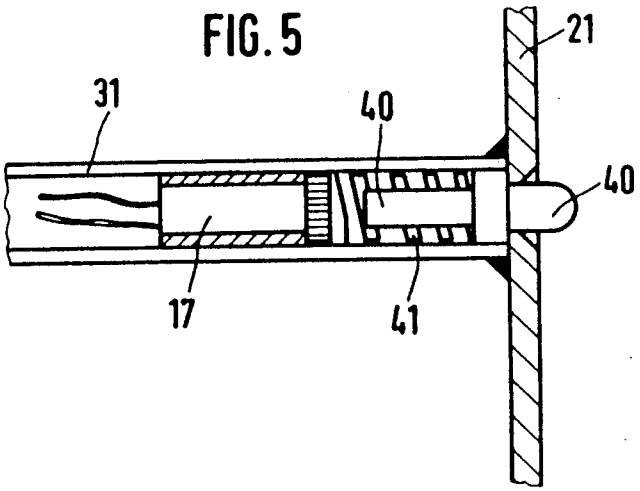
FIG. 5 is a partial side sectional view of an alternate proximity switch for the apparatus of FIG. 3.

FIG. 5 shows a modification wherein a small, spring-loaded contact pin 40 precedes the proximity switch 17, this contact pin 14 engaging through the clearance in the positioning detent 21 and being loaded by its spring 41 such that its sensor end projects slightly beyond the front face of the positioning detent 21. When the detent 21 is seated against the cavity, the pin 40 is pushed back against the force of the spring 41 and then damps the proximity switch 17 situated behind it. The interposition of the spring-loaded contact pin 40 serves the purpose of letting the worker sense that he has reached the exact seating of the positioning detent against the outside wall of the cavity.

Of course, the invention can be subject to numerous modifications. This is particularly true of the nature and of the structure of the switches, the mechanical or electrical forwarding of the switch signal from the spray probe 11 to the spray gun 10, the number of contact sensors and the evaluation of the switch signals generated by these.

Finally, it should also be pointed out that the mechanical (first exemplary embodiment) or, respectively, electrical (second exemplary embodiment) "signal bridge" between nozzle probe and spray gun is only closed when the nozzle probe is faultlessly connected to the spray gun. The apparatus of the invention thus also assures that a spray shot can only be output when the worker has properly connected the spray probe.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. An apparatus for the interior coating of cavities comprising a spray gun having a spray nozzle plug-in coupling and a spray shot trigger means and comprising nozzle probes pluggable to the spray gun, each nozzle probe being composed of a nozzle tube having a plug-in end, nozzle end and positioning detent, wherein the positioning detent is provided with at least one contact sensor that is in an interactive connection with the spray shot trigger means of the spray gun.

2. An apparatus according to claim 1, wherein at least two contact sensors are provided and are arranged at locations on the positioning detent that are distanced from one another.

3. An apparatus according to claim 1, wherein the contact sensor is a double-arm lever pivotably hinged to the positioning detent, whereby a first free end of the lever penetrates through a clearance of the positioning detent and projects from the front surface thereof in the direction toward the workpiece to be coated and a second free end of the lever is in communication via a signal line with the spray shot trigger means of the spray gun.

4. An apparatus according to claim 3, wherein the pivoted lever is connected via a Bowden cable to a sleeve that is coaxially seated on the nozzle tube and is axially disposable thereon against a spring pressure; and a proximity switch is arranged at the spray gun in the discharge region thereof at such a location that it can be damped by the displaceable sleeve.

5. An apparatus according to claim 1, wherein the contact sensor is a proximity switch that engages through a clearance of the positioning detent and aligns with the front surface thereof that faces toward the workpiece to be coated.

6. An apparatus according to claim 5, wherein the proximity switch is accommodated in a stay-like tube that leads to the plug-in end of the nozzle tube and is secured thereto, whereby electrical leads are carried in the stay-like tube.

7. An apparatus according to claim 6, wherein a contact cylinder having contact rings is arranged at the plug-in end of the nozzle probe and a contact that interacts with said contact cylinder is arranged at the plug-in end of the spray gun.

8. An apparatus according to claim 1, wherein the contact sensor is a spring-loaded contact pin that engages through a clearance in the positioning detent and projects beyond the front surface of positioning detent that faces toward the workpiece to be coated and a proximity switch is positioned behind the contact pin to be damped when the pin is pressed against its spring loading.

9. An apparatus according to claim 8, wherein the proximity switch is accommodated in a stay-like tube that leads to the plug-in end of the nozzle tube and is secured thereto, whereby electrical leads are carried in the stay-like tube.

10. An apparatus according to claim 9, wherein a contact cylinder having contact rings is arranged at the plug-in end of the nozzle probe and a contact that interacts with said contact cylinder is arranged at the plug-in end of the spray gun.

* * * * *